US007059020B2

(12) United States Patent
Sitter

(10) Patent No.: US 7,059,020 B2
(45) Date of Patent: Jun. 13, 2006

(54) HINGE FOR DOORS AND SIMILAR CONSTRUCTION COMPONENTS

(76) Inventor: Harald Sitter, Le Crêt, CH-1474, Châbles (CH)

( * ) Notice: Subject to any disclaimer, the term of this patent is extended or adjusted under 35 U.S.C. 154(b) by 160 days.

(21) Appl. No.: 10/691,538

(22) Filed: Oct. 24, 2003

(65) Prior Publication Data

US 2004/0205932 A1 Oct. 21, 2004

(30) Foreign Application Priority Data

Oct. 24, 2002 (CH) ..... 1787/02
Jan. 8, 2003 (CH) ..... 0019/03

(51) Int. Cl.
*E05D 5/00* (2006.01)

(52) U.S. Cl. ..... 16/382; 16/236; 16/242

(58) Field of Classification Search ..... 16/235–238, 16/242, 243, 245, 382
See application file for complete search history.

(56) References Cited

U.S. PATENT DOCUMENTS 1,094,010 A * 4/1914 Parsons ..... 16/379
2,217,937 A * 10/1940 Anderson ..... 16/379
2,394,014 A * 2/1946 Schonitzer ..... 16/321
2,767,425 A * 10/1956 Bradley ..... 16/338
4,304,027 A * 12/1981 Di Fazio ..... 16/249
4,438,597 A * 3/1984 Maggart ..... 49/501
4,553,286 A * 11/1985 Schwarz, II ..... 16/382
5,052,077 A * 10/1991 Lautenschlager et al. ..... 16/238
5,075,928 A * 12/1991 Bobrowski ..... 16/273
5,419,085 A * 5/1995 Imbur ..... 49/398
5,603,142 A * 2/1997 Dubach et al. ..... 16/247
5,701,636 A * 12/1997 Jahnke ..... 16/238
5,713,105 A * 2/1998 Toomey ..... 16/245
5,781,966 A * 7/1998 Ferrari et al. ..... 16/242
5,799,370 A * 9/1998 Davidian et al. ..... 16/236
5,819,372 A * 10/1998 Magoon ..... 16/382
6,145,164 A * 11/2000 Ferrari et al. ..... 16/242
6,430,779 B1 * 8/2002 Goldsmith et al. ..... 16/382

* cited by examiner

*Primary Examiner*—Robert J. Sandy
*Assistant Examiner*—Michael J. Kyle
(74) *Attorney, Agent, or Firm*—Wenderoth, Lind & Ponack, L.L.P.

(57) ABSTRACT

The invention concerns a hinge for doors and similar construction components. The hinge can be installed in a recess of a door frame, whereby the recess receives the hinge completely when the door is closed. In this way, the hinge will be completely invisible when the door is closed, and also inaccessible from the outside. This means that the hinge offers increased resistance against break-ins as well as an improved aesthetic appearance. In order to minimize the size of the required recess, the hinge flap that is nearest to the door frame incorporates a flat-angled curved profile, while the hinge flap (3) that is nearest to the door has a profile that encloses the hinge axis (4).

10 Claims, 5 Drawing Sheets

HINGE FOR DOORS AND SIMILAR CONSTRUCTION COMPONENTS

BACKGROUND OF THE INVENTION

The invention concerns a hinge for doors and similar construction components such as windows, hatches and suchlike.

Hinges of this type are commonly affixed to the outer surfaces of a door and door frame. In many cases, this has a number of disadvantages from an aesthetic point of view as well as for reasons of safety with regard to break-ins.

The purpose of the invention is therefore to avoid these disadvantages and to produce a hinge of the type mentioned above that will be invisible when the door is closed.

SUMMARY OF THE INVENTION

This task is solved in accordance with the invention by the fact that the hinge is installed in a recess of the door frame in such a way that the hinge is received into the recess completely when the door is closed.

The installed hinge therefore incorporates no projecting (i.e., no freely accessible) components whatsoever when the door is closed. This improves the aesthetic effect and also increases the resistance against break-in through manipulation of the hinge.

In order to produce as simple a construction as possible, the invention envisages that the recess which receives the hinge is formed through the interior space of a hollow profile of the door frame. Thus, the hinge can be inserted into the recess through the installation opening of the hollow profile, whose dimensions are suited to those of the hinge dimensions. This is of special advantage when, as often happens, the door frame is constructed from a suitable hollow profile anyway.

In order to minimize the size of the necessary recess, the invention envisages that the hinge incorporates two hinge flaps and a hinge bolt which connects the two with one another. The hinge flap nearest to the door frame further incorporates a simple, flat angled flap profile, while the hinge flap that is nearest to the door is equipped with a multi-angled flap profile which encloses the hinge bolt.

According to the invention the hinge flap that is nearest to the door frame consists of two flap halves which grippingly surround the hinge flap that is nearest to the door, and which are connected to one another by a narrow connection bridge, and which are further equipped with one fitting flange each.

The invention further envisages that the hinge flap that is nearest to the door can be affixed with the aid of a flange onto an insertion pocket that can be installed into the recess within the door. In this way, it will be possible to position the adjustment mechanism that is necessary for the adjustment of the installation position of the door inside the insertion pocket without the same being visible when the door is closed.

According to the invention, the recess for receiving the insertion pocket is formed through the interior space of the hollow profile of the door, and the insertion pocket can be inserted into the recess through an opening within the hollow profile wall that is dimensioned to suit the outer circumference of the insertion pocket. This embodiment is especially advantageous when, as often happens, the door leaf is equipped with a hollow profile frame anyway.

BRIEF DESCRIPTION OF THE DRAWINGS

Further details and features of the invention will be found in the following description with reference to the drawings, whereby.

DETAILED DESCRIPTION OF THE INVENTION

Figure 1:
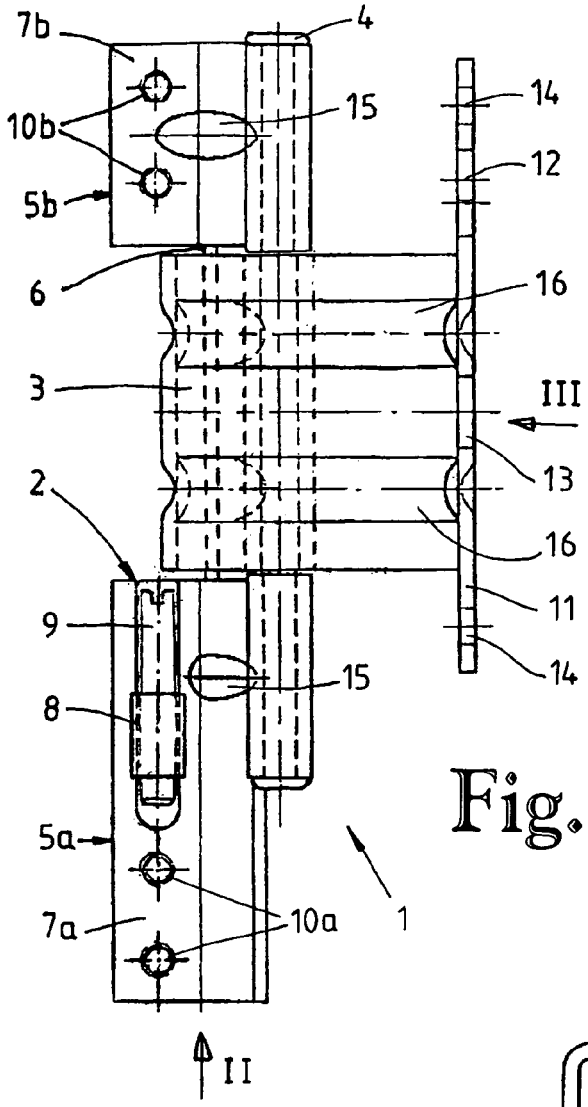
FIG. 1 shows a frontal view of a hinge according to this invention.
Figure 3:
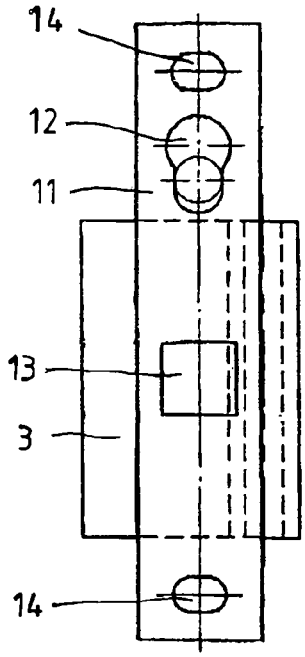
FIG. 3 shows a partial view of the hinge in the direction of the arrow III illustrated in FIG. 1.
Figure 2:
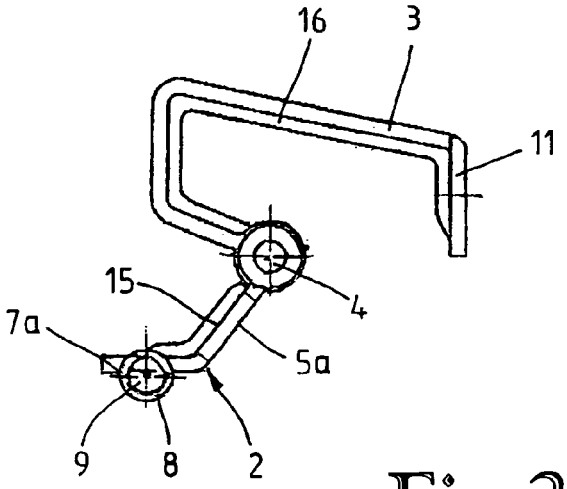
FIG. 2 shows a view of the hinge in the direction of the arrow II illustrated in FIG. 1.

The hinge (1) shown in FIGS. 1 to 3 consists of two hinge flaps (2 and 3) which are connected with one another with the aid of a hinge bolt (4).

The frame hinge flap (2) that is nearest to (attached to) the door frame incorporates a flat angled simple flap profile. The door hinge flap (3) that is nearest to (attached to) the door is equipped with a multi-angled flap profile which encloses the hinge bolt (4).

The frame hinge flap (2) that is nearest to the door frame consists of two (a first and second) flap halves (5*a*, 5*b*) which grippingly surround the door hinge flap (3) that is nearest to the door, and the flap halves are connected with one another with the aid of a narrow connection bridge (6), and each flap half has a fitting flange (7*a*, i.e. 7*b*). The first flap half (5*a*) of the hinge flap (2) has a threaded sleeve (8), into which a threaded bolt (9) is inserted via a thread for the height (upwards and downwards) adjustment of the hinge. In other words, bolt (9) and sleeve (8) form a height-adjusting mechanism. The fitting flanges (7*a* and 7*b*) incorporate threaded bores (10*a*, i.e. 10*b*) for the installation of fitting screws, which are not illustrated here.

The door hinge flap (3) that is nearest to the door incorporates a fitting flange (11), which is in turn equipped with a keyhole forming opening (12), a central square opening (13), and longitudinal holes (14) for the fitting screws that are not illustrated here. Ridges (15, 16) for the increasing the stiffness of these components are provided within the hinge flap (2) as well as within the hinge flap (3). Both hinge flaps can further incorporate gently curved flap profiles instead of the sharply angled profiles.

Figure 4:
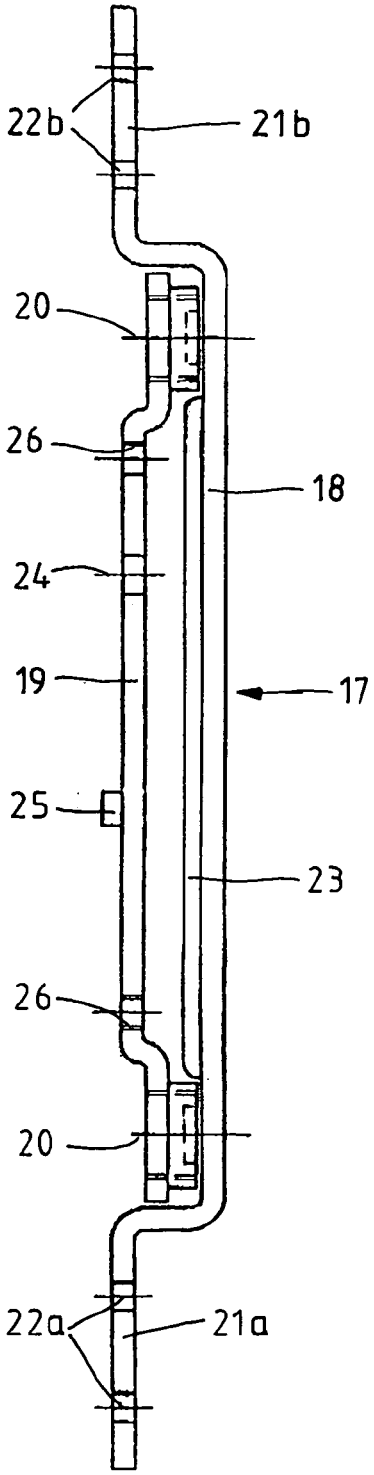
FIG. 4 shows an insertion pocket for the installation of the hinge.
Figure 5:
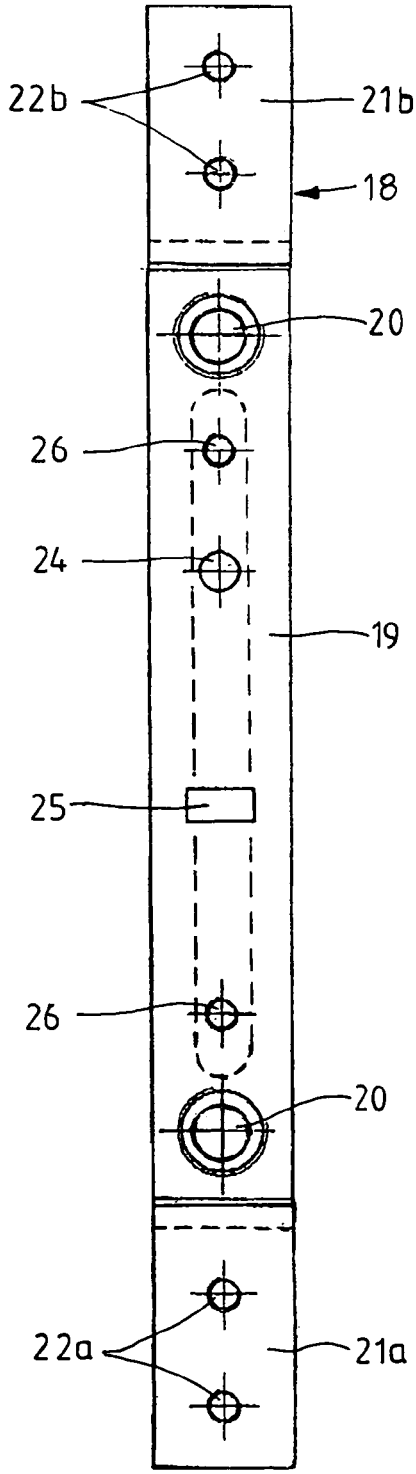
FIG. 5 shows a view of the insertion pocket in the direction of the arrow V illustrated in FIG. 4.
Figure 6:
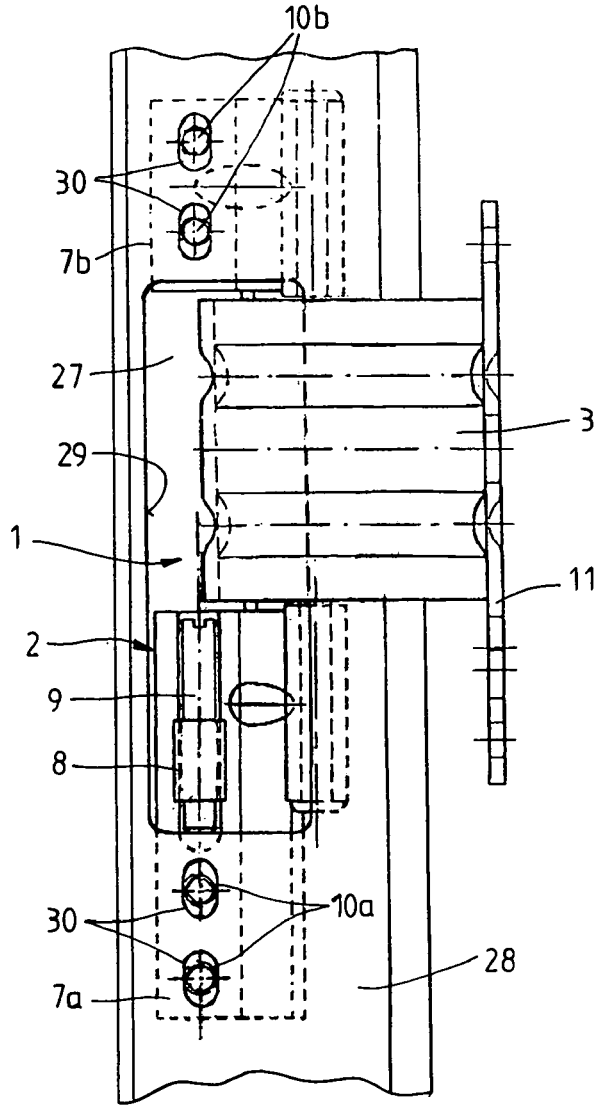
FIG. 6 shows the hinge illustrated in FIG. 1, which has here been installed into a door frame.
Figure 7:
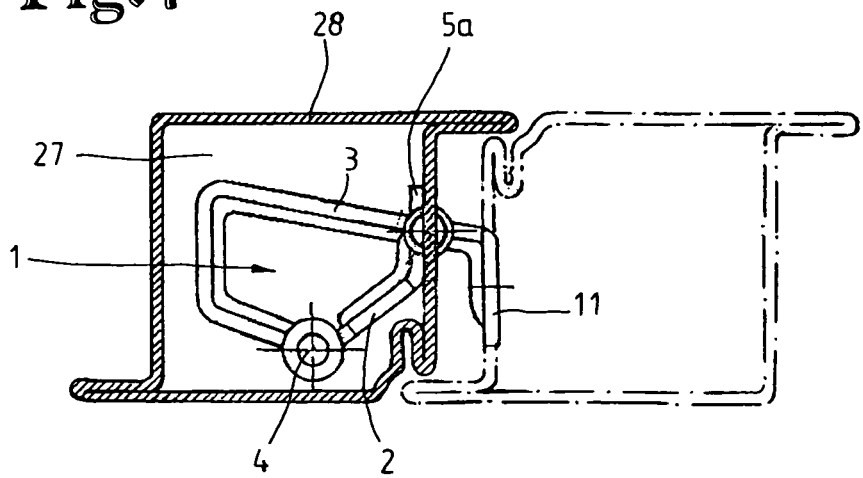
FIG. 7 shows the hinge illustrated in FIG. 1, which has here been installed into a door frame and is shown while the door is closed.

The insertion pocket (17) illustrated in FIGS. 4 and 5 consists of an internal tab (18) and an external tab (19) resting upon the internal tab, which are screwed to one another with the aid of set screws (20) positioned at their respective ends. The internal tab (18) further incorporates a fitting flange (21*a*, 21*b*) with threaded bores (22*a*, 22*b*) for the fitting screws that are not illustrated here. In order to increase the stiffness of the internal tab, a ridge (23) is provided. The external tab (19) has a bore (24) into which a set bolt with an eccentric cam is inserted, which is not shown here. The external tab further has a hump-shaped shoulder (25) as well as threaded bores (26), into which the fitting screws which are not illustrated here can be inserted.

FIGS. 6 to 9 show the hinge (1) in its installed position. As is clearly visible in FIGS. 6 and 7, the hinge is installed into a recess (27) of the door frame which is formed by the hollow profile (28). The hinge (1) is inserted through an installation opening (29) of the hollow profile (28) into the recess (27) in this way. Following this, the frame hinge flap (2) is affixed to the hollow profile (28) of the frame with screws which are not illustrated here, and which are inserted through the longitudinal holes (30) of the hollow profile (28) and screwed into the threaded bores (10*a*, 10*b*) of the fitting flange (7*a*, 7*b*). The installation height of the hinge (1) can be adjusted with the aid of the threaded bolt (9), which is supported against the edge of the hollow profile (28) within the edge area of the installation opening (29). In order to adjust the installation height of the hinge, the threaded bolt (9) is screwed into or out of the threaded sleeve (8).

The dimensions of the installation opening (29) are suited to those of the hinge. The installation opening (29) in turn is sized in such a way that the insertion of the hinge as well as the projection and retraction of the hinge flap (3) into and out of the recess (27) are possible on the one hand, while the fitting flange (7*a* and 7*b*) of the hinge flap (2) fully overlaps the internal surface of the hollow profile (28) on the other hand.

Figure 8:
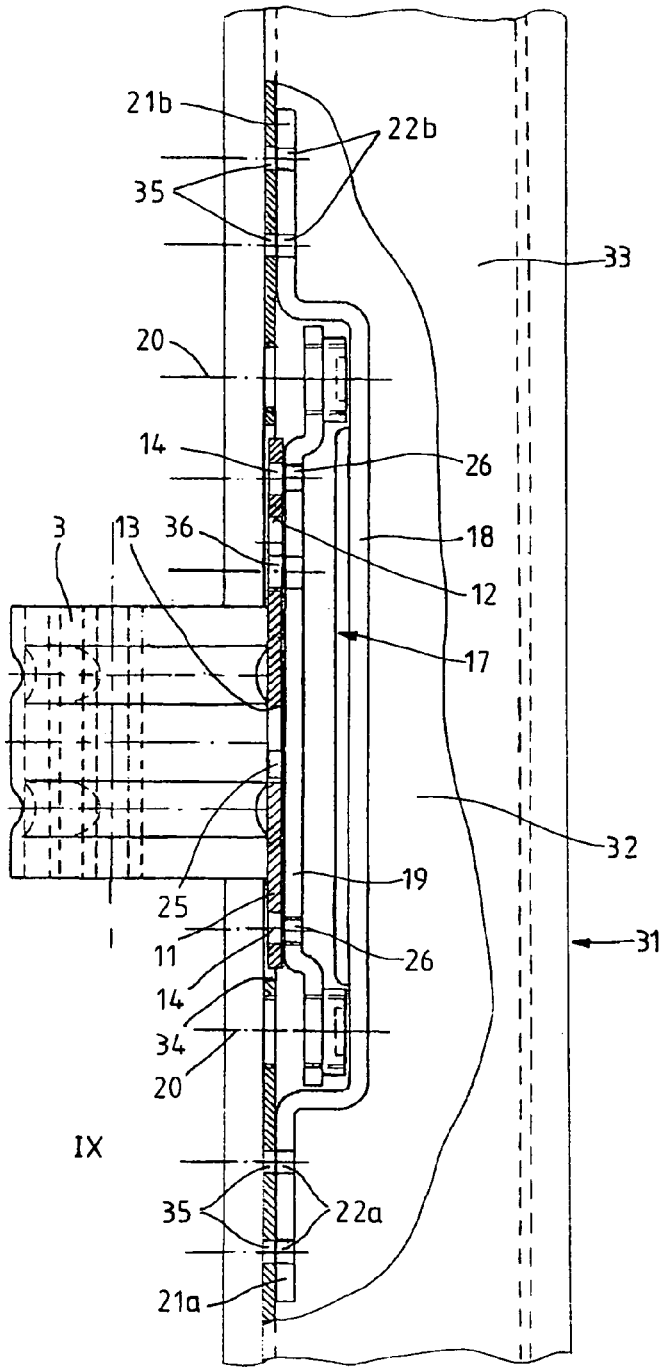
FIG. 8 shows the installation of the hinge on a door together with the insertion pocket illustrated in FIGS. 4 and 5.
Figure 9:
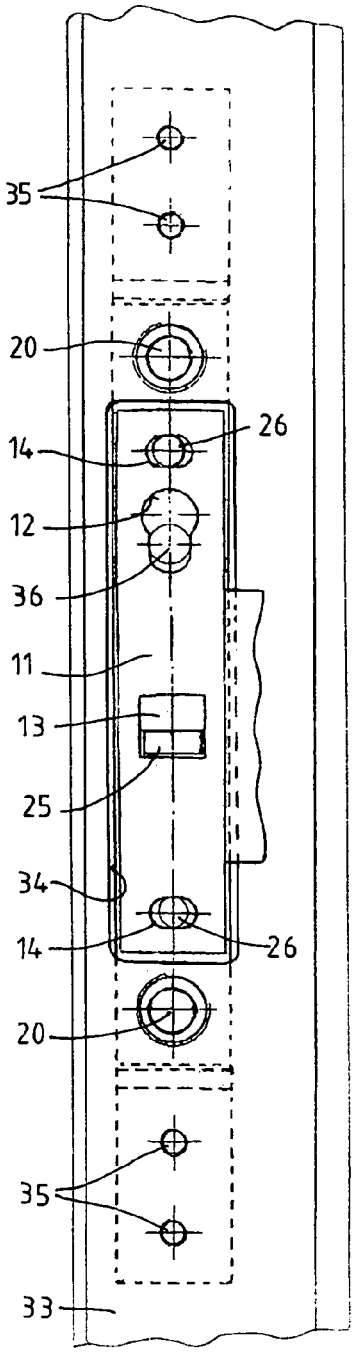
FIG. 9 shows a view of the hinge installation in the direction of the arrow IX illustrated in FIG. 8.

FIGS. 8 and 9 show the fitting of the hinge (1) onto the door (31). As is clearly apparent from FIG. 8, the insertion pocket (17) is installed into the recess (32) of a hollow profile (33) of the door (31). The insertion pocket (17) is inserted into the recess (32) through an opening (34) of the hollow profile (33). The opening (34) is sized to suit the external circumference of the insertion pocket in such a way that the insertion of the insertion pocket into the recess (32) is possible on the one hand, yet the fitting flange (21*a*, 21*b*) of the internal tab (18) completely overlaps the internal surface of the hollow profile (33) on the other hand.

The fitting of the insertion pocket (17) into the hollow profile (33) is effected with the aid of fitting screws (are not illustrated here) which are screwed into the bores (35) of the hollow profile (33) and into the threaded bores (22*a*, 22*b*) of the internal tab (18).

In order to install the door, the door is initially positioned in relation to the hinge flap (3). This is carried out with the aid of the shoulder (25) that is envisaged upon the external tab (19), and with the adjustment bolt (not shown) with the eccentric cams (36).

For positioning of the door, the shoulder (25) and the eccentric cams (36) are first inserted into the openings (13, 12) within the fitting flange (11) of the hinge flap (3), whereby the shoulder (25) simultaneously takes up the weight of the door. A turning of the adjustment bolt with the eccentric cams (36) will now enable the comfortable adjustment of the installation position of the door in a traverse direction to the door level (i.e., adjustment in a thickness direction of the door).

The fitting of the hinge flap (3) onto the external tab (19) of the insertion pocket (17) is achieved subsequently with the aid of fitting screws that are not illustrated here, and which are inserted through the longitudinal holes (14) within the fitting flange (11) of the hinge flap (3) and screwed into the threaded bores (26) of the external tab (19). The installation position of the door in the direction of the level of the door (i.e., with respect to the surface of the door in which the recess is formed and to which the hinge is applied) is adjustable by screwing the set screws (20) either in or out.

It would of course also be possible according to the invention to effect the installation of the hinge in a reverse manner, namely to install the hinge (1) within the recess (32) of the door (31) and then to position the insertion pocket (17) within the recess (27) of the door frame (28). As is perfectly obvious, one would solve the task of the invention and achieve the advantages according to the same just as well in this way as one would with the embodiment described above.

Figure 10:
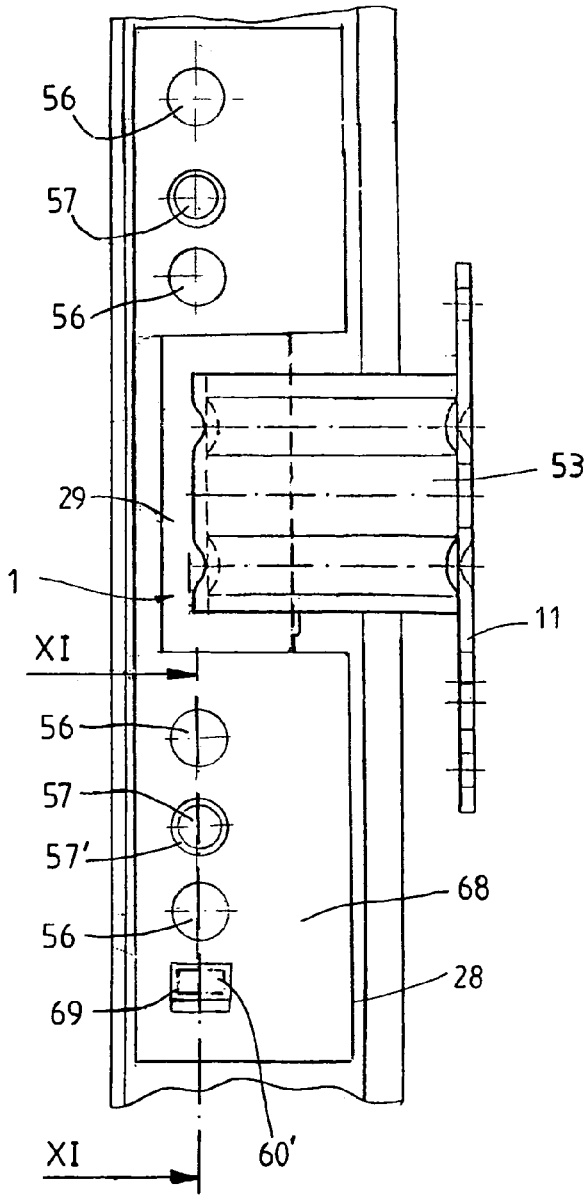
FIG. 10 shows a further embodiment of a hinge according to this invention which has here been installed within a door frame.
Figure 11:
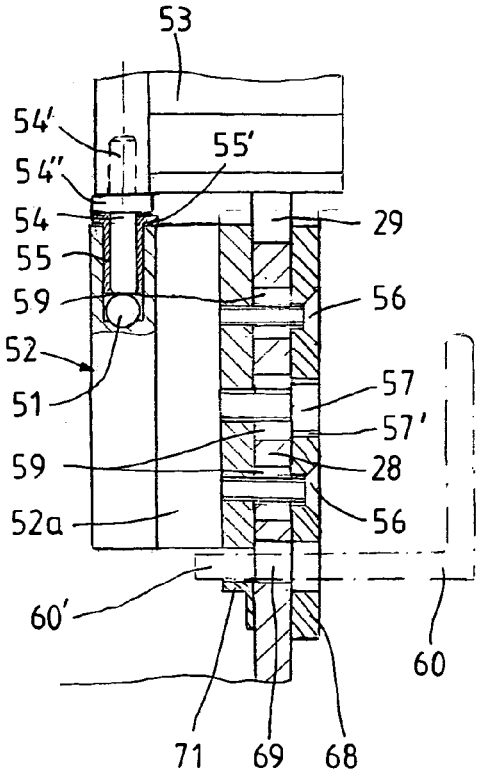
FIG. 11 shows a partial longitudinal cross-section of the hinge along the line XI—XI illustrated in FIG. 10.

The FIGS. 10 and 11 show a further embodiment of a hinge (50) according to this invention, with regard to which only the differences in comparison with the embodiment illustrated in FIGS. 1 to 9 will be detailed more fully below, and whereby we refer to the above description for the remainder of the description.

The hinge (50) illustrated here once again consists of a fixed hinge flap (52) incorporating two flap halves (52*a*) and a moveable hinge flap (53), which are connected with one another by one hinge bolt (54) each. The hinge bolt (54) is preferably constructed from hardened steel as is clearly visible in FIG. 11, and consists of a pin (54') that is held within the hinge flap (53), a projecting central ring section (54") and a pin (54') which is positioned within a self-greasing bronze bushing (55) or similar, and which is located within the hinge flap (52) with its lower facing side of a preferably hardened ball (51). The bronze bushing (55) is also equipped with a projecting ring (55') at its upper side, whereby the bushing stands in sliding contact with the ring section (54") of the hinge bolt (54). As a result, an installation of a door with a weight of approximately 250 kg will function with relatively little friction and will guarantee a high lifespan. The hinge flap (53) that is shown here only in part is further equipped with the same bearing mechanism at its upper end.

The flap halves (52*a*) of the hinge flap (52), the lower one of which is illustrated in FIG. 11, are affixed to the internal side of the hollow profile (28). In place of the threaded sleeve (8) and the bolt (9) for the height adjustment of the flap in relation to the frame, two countersunk screws (56) and a cylinder head screw (57) between the countersunk screws are positioned together upon an axis along the hollow profile (28), as well as a U-shaped cover plate (68), which abuts against the hollow profile (28) on the outside of the same. These three screws (56, 57) for a flap half (52*a*) are screwed into this flap half (52*a*) with the aid of the relevant threads in their installed condition. The hollow profile (28), however, incorporates longitudinally orientated longitudinal grooves (59), and the cover plate (68) incorporates suitable cut-outs for the cylinder head screw (57) as well as a bore (57'), which is only slightly larger than the external diameter of the screw head.

According to the invention, an opening (69) is positioned below the hinge (52, 53), and the opening extends straight across the hollow profile (28) and the cover plate (68), and an angled overlay (71), which extends against the inside of the profile at the lower end of this opening. This opening (69) serves for the receiving of a lifting key (60) for the installation (i.e., for the height adjustment of the hinge in relation to the hollow profile) whereby the lower flap half (52*a*) lies immediately next to the upper end of the opening, so that the flap half (52*a*) can be adjusted with this lifting key.

This lifting key (60) which serves as a tool is formed in such a way that the hinge (52, 53) can be adjusted with the key 60 in relation to the hollow profile (28) through manual manipulation. To this purpose, the lifting key (60) consists of a square section (60') for the lifting of the flap half (52*a*) of the hinge, and a grip element for the manual activation of the key which preferably projects at a right angle from the same square section (60').

The fitting flange (11) preferably incorporates two key-shaped openings (12) instead of the longitudinal hole (14) and the square opening (13) illustrated in FIG. 3. In this way, the door can be hung on the fitting flanges quite comfortably and easily.

It is further possible to effect a simple installation of the hinge (50) within the hollow profile (28) in this way. Firstly, the flap halves (52*a*) can be individually inserted into the hollow space through the installation opening (29), where they are initially and provisionally fastened by one cylinder head screw (57) each. A lifting key is inserted into the opening (69), so that the flap halves will not fall into the fixed profile (28). The turnable hinge flap (53) is then inserted into the flap halves (52*a*, 52*b*) together with the hinge bolt (54) affixed to the same, so that the same is turnably affixed to the same. Following this installation of the hinge flap (53), the height of the door can be adjusted, whereby the six screws (56, 57) are initially loosened, and whereby the hinge flaps (52, 53) are then all together adjusted upwards or downwards with the aid of the lifting key (height adjusting mechanism) which has been inserted into the opening (69), and whereby the screws are then fastened while the key is held firmly. For a cross-directional adjustment of the door, the position of the relevant screws of the fitting flange (11) can be changed, as has already been described in more detail above.

It is possible to open a door as far as 115° or more with the hinges of this invention. They further guarantee a load bearing capacity of up to 250 kg and more. The hinge also enables three-dimensional adjustment of the door in relation to the frame, namely vertically upwards, downwards, horizontally to the left, to the right, and horizontally towards the front, towards the back. This enables a simple and accurate alignment of the door to the frame.

What is claimed is:

1. A hinge for doors, comprising:

a frame hinge flap to be located within a recess of a door frame having a hollow profile, said frame hinge flap being height-adjustable with respect to the door frame;

a door hinge flap connected to said frame hinge flap, said door hinge flap having a fitting flange; and an insertion pocket to be located within a recess of a door having a hollow profile, said insertion pocket including:

an internal tab to be attached to an internal surface of the hollow profile of the door;

an external tab supported by said internal tab and attached to said fitting flange of said door hinge flap, said external tab including an adjustment bolt with an eccentric rotatable cam cooperating with a key-hole-shaped opening in said fitting flange of said door hinge flap for adjustment of said door hinge flap in a thickness direction of the door; and set screws for connecting said internal tab and said external tab to each other, said set screws being operable to adjust a position of said external tab and said door hinge flap relative to a surface of the door in which the recess of the door is formed;

wherein said frame hinge flap, said door hinge flap, and said insertion pocket are shaped and arranged to be located within one of the recess of the door frame and the recess of the door when the door is closed so that said hinge is completely invisible when the door is closed.

2. The hinge of claim 1, wherein said frame hinge flap is to be inserted into the recess of the door frame through an installation opening, and the dimensions of the installation opening correspond to the dimensions of said frame hinge flap.

3. The hinge of claim 1, wherein said frame hinge flap and said door hinge flap are connected to each other by a hinge bolt, said frame hinge flap having a flat-angled simple flap profile, and said door hinge flap having a multi-angled flap profile enclosing said hinge bolt.

4. The hinge of claim 3 wherein said frame hinge flap is to be attached to an internal surface of the hollow profile of the door frame.

5. The hinge of claim 3, wherein said frame hinge flap comprises two flap halves located on both sides of said door hinge flap, said frame hinge flap and said door hinge flap being pivotally connected to each other by said hinge bolt.

6. The hinge of claim 3, wherein said insertion pocket is to be inserted into the recess of the door through an installation opening, and the dimensions of the installation opening correspond to the dimensions of said insertion pocket.

7. The hinge of claim 1, further comprising a cover plate arranged on an external surface of the hollow profile of the door frame for connection to said frame hinge flap via the hollow profile of the door frame.

8. The hinge of claim 7, wherein said cover plate has an opening aligned with an opening extending through the hollow profile of the door frame, further comprising a lifting key to be inserted into said opening of said cover plate and into the opening of the hollow profile of the door frame to adjust a height of said frame hinge flap.

9. The hinge of claim 8, wherein said lifting key has a square section for contacting and lifting said frame hinge flap, and a grip element for manual activation of said lifting key, said grip element projecting at a right angle from said square section.

10. The hinge of claim 1, wherein said frame hinge flap has a threaded sleeve and includes a threaded bolt threaded into said threaded sleeve for adjustment of a height of said frame hinge flap.

* * * * *